US006203415B1

(12) United States Patent
Torrance-Castanza et al.

(10) Patent No.: US 6,203,415 B1
(45) Date of Patent: Mar. 20, 2001

(54) DIRECT DRIVE WATER-DRIVEN ROTARY TOOL

(76) Inventors: Laura C. Torrance-Castanza; James J. Castanza, both of 641 Ibis Dr., Delray Beach, FL (US) 33444

( * ) Notice: Subject to any disclaimer, the term of this patent is extended or adjusted under 35 U.S.C. 154(b) by 0 days.

(21) Appl. No.: 09/345,275

(22) Filed: Jun. 30, 1999

(51) Int. Cl.[7] ..... B24B 23/00

(52) U.S. Cl. ..... 451/359; 451/295; 451/344; 451/294; 451/353; 173/DIG. 1

(58) Field of Search ..... 451/294, 295, 451/344, 353, 359; 173/216, 218, 169, 168, DIG. 1

(56) References Cited

U.S. PATENT DOCUMENTS

| | | | | |
|---|---|---|---|---|
| 2,326,396 | * | 8/1943 | Schaedler . | |
| 3,722,147 | * | 3/1973 | Brenner | 51/170 T |
| 4,193,228 | * | 3/1980 | Bowler | 51/170 T |
| 4,279,051 | * | 7/1981 | Malcolm | 15/29 |
| 4,370,771 | * | 2/1983 | Gonazlvo | 15/29 |
| 4,399,638 | * | 8/1983 | Rodowsky, Jr. et al. | 51/170 R |
| 4,660,329 | * | 4/1987 | Hutchins | 51/170 |
| 4,773,120 | * | 9/1988 | Wang | 15/344 |
| 4,856,133 | * | 8/1989 | Sanchez | 15/29 |
| 4,898,524 | * | 2/1990 | Butzen | 418/136 |
| 5,044,034 | * | 9/1991 | Iannucci | 15/1.7 |
| 5,345,726 | * | 9/1994 | Gach | 451/450 |
| 5,620,364 | | 4/1997 | Torrance . | |
| 5,707,032 | * | 1/1998 | Ehrlich | 248/205.3 |
| 5,709,793 | * | 1/1998 | Kisner | 210/169 |
| 5,807,169 | * | 9/1998 | Martin et al. | 451/357 |
| 5,813,903 | * | 9/1998 | Amano et al. | 451/294 |

* cited by examiner

*Primary Examiner*—Lee Young
*Assistant Examiner*—Minh Trinh
(74) *Attorney, Agent, or Firm*—Malin, Haley & DiMaggio, P.A.

(57) ABSTRACT

An improved multi-purpose, direct-drive, water-driven rotary tool having improved torque and power. The present invention includes a housing having a central cavity, an impeller with angled, beveled blades around its periphery, a drive shaft connected to a rotatable mounting pad or backing pad that contains a disk with a grinding or sanding surface that is removably attached thereto. A high pressure water inlet conduit includes a changeable nozzle to allow using the tool with different water sources. The water exiting the nozzle strikes the blades of the impeller, rotating the impeller, which rotates the backing pad and sanding disk. Water is strategically diverted through a bearing mounting plate having holes by a shroud or angular flange having an angular periphery that allows the expended water from the impeller to be efficiently expelled peripherally around the outside of the main cavity of the housing. The device also includes a manually-actuated trigger for the inlet water valve which can be held at the same time as a D-shaped handle affixed directly on the housing allowing for close, controlled used or with a saddle handle that is pivotal and that allows the user to attach the saddle handle to a long pool-pole to effectively move the device comfortably from a standing position.

15 Claims, 5 Drawing Sheets

DIRECT DRIVE WATER-DRIVEN ROTARY TOOL

BACKGROUND OF THE INVENTION

1. Field of the Invention

This invention relates to a direct drive water-driven rotary tool used for wet grinding, wet polishing, or wet sanding of many surfaces, including stone, cement, fiberglass, wood and metal surfaces, wherein the tool is used in a water filled or water containing environment, and specifically to an improved direct drive water-driven grinder and sander that eliminates the use of internal gears thereby reducing wear on internal bearings, has improved efficiency and reliability, creates higher torque and power and is easy to manipulate when in use.

2. Description of the Prior Art

Hydraulic driven rotational tools are known in the prior art. U.S. Pat. No. 1,905,424 issued to R. Schlieper, dated Apr. 25, 1933, shows a hydraulic driven washing apparatus which is a cleaning apparatus for cars that uses a garden hose to provide rotary motion to a sponge. U.S. Pat. No. 4,193,228 issued to Bowler, dated Mar. 18, 1980, provides a water-driven tool that can be used for polishing tile around a swimming pool or shower in a water environment. U.S. Pat. No. 4,463,525 issued to Sheber, dated Aug. 7, 1984, shows a hand-held cleaning tool with a remote water turbine power source contained in a floating housing. The outlet of the water turbine is connected to one end of a suction hose. A flexible drive cable assembly has one end connected to the cleaning tool and the other end connected to the water turbine. U.S. Pat. No. 5,620,364 issued to Torrance et al., dated Apr. 15, 1997, shows a hand-held water-driven rotary tool and uses water pressure to drive an internal gear and impeller to create the required torque.

One drawback of liquid-driven rotary tools shown in the prior art is that they do not produce sufficient torque to do a satisfactory grinding and sanding job. Another problem with the tools shown in the prior art is that they are awkward and uncomfortable to hold in position while in use.

The present invention overcomes these problems by providing a high torque water-driven sander and grinder. The device can be specially adapted for a plurality of uses within an already water filled environment such as a pool where it would not be practical to provide electrical power directly to the tool itself. Although electric motors do provide the high torque necessary for certain sanding and grinding operations, their use under water is totally impractical due to the dangers of electrocution and the inoperability of the motor in a totally enclosed environment. Therefore, the use of a high torque rotary power source for wet grinding or wet polishing of stones, cement, fiberglass and even wood and metal surfaces in a water filled or water containing environment is desirable. Such tools may be polishers, grinders, cutting tools, polishing and grinding disks, cutting disks and blades and possibly other uses for pumps, engines, cement mixes and grouts.

The present invention provides for high torque while at the same time providing a housing that includes a handle and trigger mechanism which allows for easy manipulation while the tool is being used, as well as providing ease of turning the device on and off.

In the device shown in U.S. Pat. No. 1,905,424 to R. Schlieper, the water impacting the turbine is deflected out through holes in sponges that are used to wash a vehicle. The disk shown in U.S. Pat. No. 4,193,228 to Bowler protrudes outwardly from the impeller housing and is disposed away from the housing itself. In the device shown in U.S. Pat. No. 5,620,364 to Torrance et al. ("the '364 patent"), a gear is locked and keyed to a centrally-mounted shaft so that as the gear is rotated by the impeller, the shaft also rotates causing the pad which retains the working disc to also rotate thereby allowing the device to operate. However, a major drawback of the '364 patent is the wear imparted upon the internal bearings due to the high speed of the rotating gear. The gear must rotate at 20,000 RPM to create the torque necessary to spin the cutting disc at 3,000 to 4,000 RPM, which is the required speed necessary to complete an ordinary job. The heat generated at 20,000 RPM tends to wear down the internal bearings which can ultimately lead to the bearing spinning faster than the shaft. This decreases the torque, creating cavitation, internal damage and insufficient performance.

In the present invention, the internal gears are eliminated, thereby reducing the number of internal parts and virtually eliminating damage to the bearings. The sanding disk or grinding disk is removably mounted to a backing pad in the housing for increased torque and mobility of the apparatus. The water used to drive the turbine is strategically diverted through a series of apertures so as to maximize torque created by the inlet water spray on the turbine allowing the sanding and grinding disk to operate to its full capacity.

SUMMARY OF THE INVENTION

An improved direct drive water-driven rotary tool for sanding or grinding in a water filled environment comprising a substantially annular rigid metal housing having a central cylindrical cavity, a substantially annular inlet conduit connected to a water supply under pressure, a cylindrically-shaped dish which is affixed directly on top of the housing including an angled, beveled aperture to allow for the elongated inlet conduit to protrude therethrough, a water-driven impeller rotatably mounted in the housing cavity and having a plurality of curved blades and a central aperture to allow for a drive shaft to be inserted therethrough, an outer metal support plate with a series of apertures around its perimeter, a large circular backing pad removably mounted on one side that can receive thin disk-shaped throw-away sanding or grinding surfaces that are attached to the backing pad surface, a saddle-shaped, pole-attaching handle pivotally affixed to the outside of the housing, a D-shaped, Spade handle affixed to the outside of the housing, and a shroud for deflecting water away peripherally, from the operator.

The housing includes a cylindrical cavity centrally positioned within the housing. A substantially cylindrical drive shaft is positioned within the cavity of the housing and is secured therein by a first circular bearing. The drive shaft is also secured to the impeller.

The water inlet conduit which is formed with and protrudes from the upper portion of the housing includes a changeable nozzle for accelerating inlet water under pressure and is directionally oriented so that the output of the nozzle allows water to strike the impeller blades near their radial ends, causing high torque on the impeller.

The cylindrically-shaped dish is affixed directly on top of the housing and includes a central cylindrical cavity which coincides with the central cavity in the housing, an angled, beveled, aperture to allow for the nozzle protruding from the housing beneath the dish to extend up through the dish in order to allow the exiting water to strike the impeller blades.

The impeller is strategically situated in close proximity to the nozzle and deep within the cylindrically-shaped dish in order for the water that exits the nozzle to strike the blades of the impeller directly with little or no diversion of water. The impeller has a central aperture that receives and is secured to the drive shaft. It is the rotation of the impeller that rotates the drive shaft. The rotation of the drive shaft, in turn, rotates the backing pad and sanding disk to perform the required task. A second circular bearing is attached to the second end of the drive shaft in order to assure true rotation of impeller and drive shaft.

Different nozzles having different sized inside diameters or degrees of output can be used with different water pressure sources to maintain a constant impeller RPM resulting in a constant tool output RPM. By having changeable nozzles, the tool can be used with existing high pressure water sources of different pressure values and gallons per minute, to operate the tool at a single desired RPM rate for maximum efficiency.

The support plate has a plurality of strategically spaced holes or passages around its periphery to allow water, after it strikes the impeller blades, to flow through the support plate. A disk-shaped shroud having an angled peripheral edge diverter flange, slightly larger than the diameter of the backing pad is attached to the support plate. The angle of the shroud is approximately 30 degrees, which is sufficient to refract the water away from the operator. The shroud is attached by a plurality of fasteners to the outer perimeter of the bearing support plate. Water passes between the dish periphery and is forced outwardly onto the backing pad where the water escapes.

The backing pad is threadably connected to the drive shaft. One side of the backing pad is covered in VELCRO™ to allow the backing pad to adhere to the sanding disks, also covered in VELCRO™.

Affixed to the inlet conduit of the housing is a water inlet valve that includes a hand-actuated trigger (valve handle assembly) that allows the device to be turned on and off through controlling of the inlet water pressure and flow from the hand-actuated valve.

The saddle handle is basically U-shaped and has a pair of apertures, one on each end of each U-shaped portion that receives a connecting screw and washer to allow the saddle handle to be attached to the outside of the housing diametrically for pivoting to allow positioning of the tool by the user. The saddle handle also includes a male portion that engages the female end of a pool pole so that the device can be used by an operator standing upright in a comfortable position.

The pivotal saddle-shaped handle has a hand-sized cylindrical protrusion sized for grasping by the hand, which also includes a hollow cylindrical male end to allow a pool pole to be affixed to the saddle-shaped handle.

The water inlet control valve has a valve actuating lever that can be squeezed with a person's hand. Water received from a high pressure source such as a pump above 1500 psi, comes through the inlet conduit and nozzle, strikes the impeller, causing the drive shaft to rotate as the impeller rotates which in turn rotates the backing pad and sanding disk. The water that is expended against the impeller blades is diverted under pressure through holes in the bearing support plate against the shroud which directs the water outwardly and efficiently, away from the backing pad. This reduces back pressure and allows for increased torque in the device.

In a typical operating environment such as a pool filled with water, a sanding or grinding disk is affixed to the front surface of the backing pad. A gas-powered motor may provide the necessary drive power for a water pump which allows water to be pumped directly to the inlet conduit through quick disconnect that allows the device to be connected to a conduit that has the pressurized water source. The manual valve can be turned on while the tool is being held by the saddle handle and the valve actuating handle so the backing pad and grinding or sanding disk will rotate with high torque. The device can be safely used underwater while still maintaining a high torque output. The device can also be used in a dry environment to reduce dust particles using the water that is sprayed from the tool while grinding or sanding.

In an alternate embodiment, a D-shaped Spade handle can be affixed to the outside of the housing allowing a user to firmly grip the handle, thereby providing close-up use, for especially difficult-to-reach or rough sanding or grinding surfaces.

It is an object of this invention to provide an improved direct-drive, water actuated rotary tool of high torque especially used for grinding, scraping or polishing within a dry or water filled or water surrounding environment without danger of electrical shock.

Another object of this invention is to provide an improved direct-drive water actuated rotary tool that provides for high torque and easy manipulation in use, and a water spray for reducing dust.

It is yet another object of this invention to provide an improved direct-drive, water actuated rotary tool for grinding, polishing and sanding especially for use in a pool that provides for expended water to be diverted peripherally and centrifugally from the device.

It is yet another object of this invention to provide an improved direct-drive, water actuated rotary tool that operates without the use of internal gears, thereby eliminating damage to internal bearings which would lead to cavitation of the drive shaft leading to insufficient performance.

It is still another object of this invention to provide an improved direct-drive, water actuated rotary tool that provides increased torque and power due to the impeller being situated in very close proximity to the water exiting the nozzle, thereby decreasing the amount of escaping water, creating a more efficient rotary tool.

It is still another object of this invention to provide an improved direct-drive, water actuated rotary tool that operates quietly and efficiently and allows the user to use standard parts and convention tools to replace components easily.

In accordance with these and other objects which will become apparent hereinafter, the instant invention will now be described with particular reference to the accompanying drawings.

DESCRIPTION OF THE PREFERRED EMBODIMENTS

Figure 1:
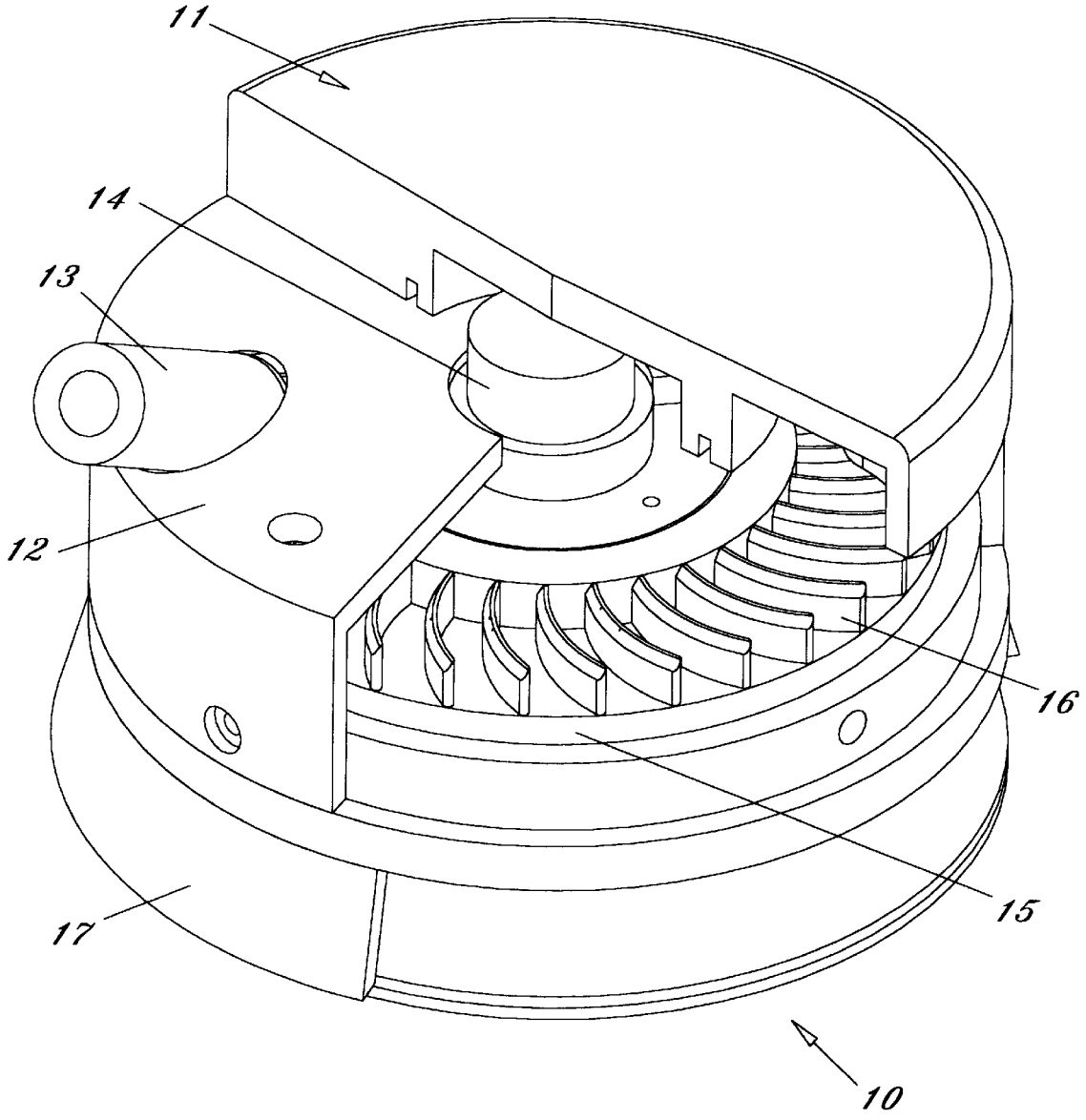
FIG. 1 shows a bottom perspective view of the present invention partially cut away in cross-section.

Referring now to the drawings and in particular, to the partially cut-away view of FIG. 1, the present invention is shown generally at 10, comprised of a substantially annular rigid metal housing 11, a substantially annular metal dish 12, a water inlet conduit 13, a drive shaft 14, an impeller 15 with a plurality of blades 16 around its periphery 16, and a shroud 17. Further components of the present invention not shown in FIG. 1 will be discussed below.

Figure 2:
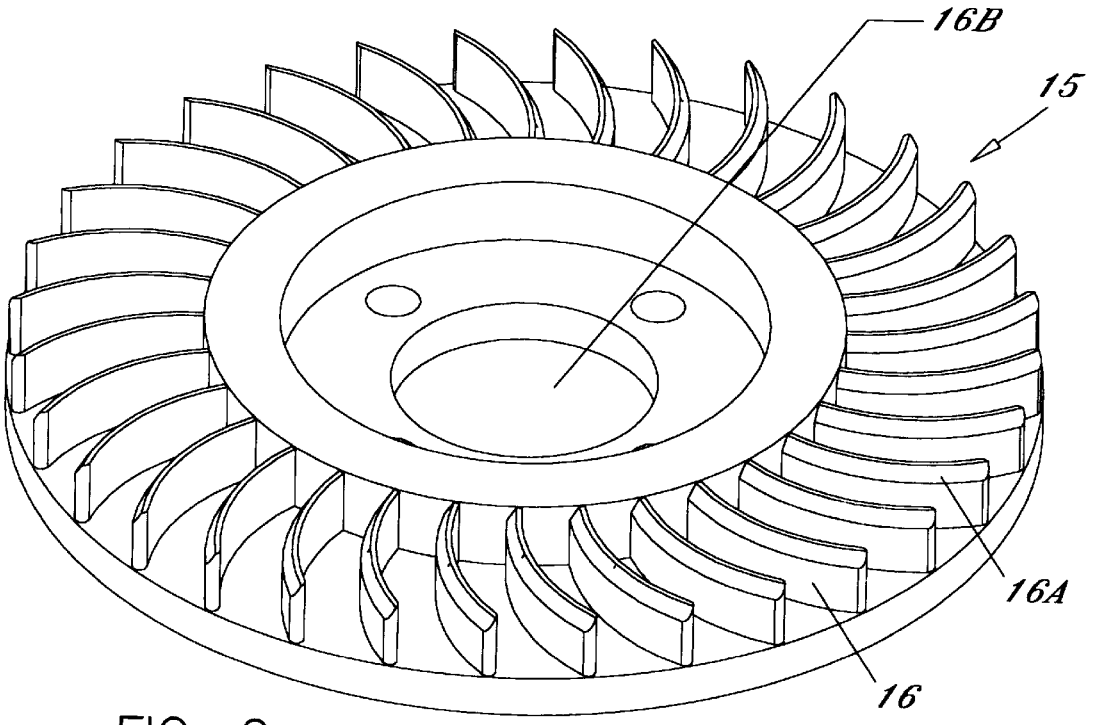
FIG. 2 shows a perspective view of the impeller used in the present invention.

Referring to FIG. 2, impeller 15 has a plurality of impeller blades 16 radially disposed about its periphery and a central, circular hole 16B. The impeller 15 is rotatably mounted to the drive shaft wherein the drive shaft protrudes through hole 16B of impeller 15.

An improvement of the present invention over previous designs is the size, shape and orientation of the impeller blades. FIG. 2 shows impeller 15, having a plurality of curved blades 16 around the impeller's periphery. Each blade is larger and more curved than the blades of previous designs and have beveled top edges 16A, allowing the water exiting the nozzle enclosed within conduit 13, shown clearly in FIG. 4, to strike the flat edge of each blade 16, thereby providing greater torque and allowing for less resistance as the impeller 15 rotates.

Figure 4:
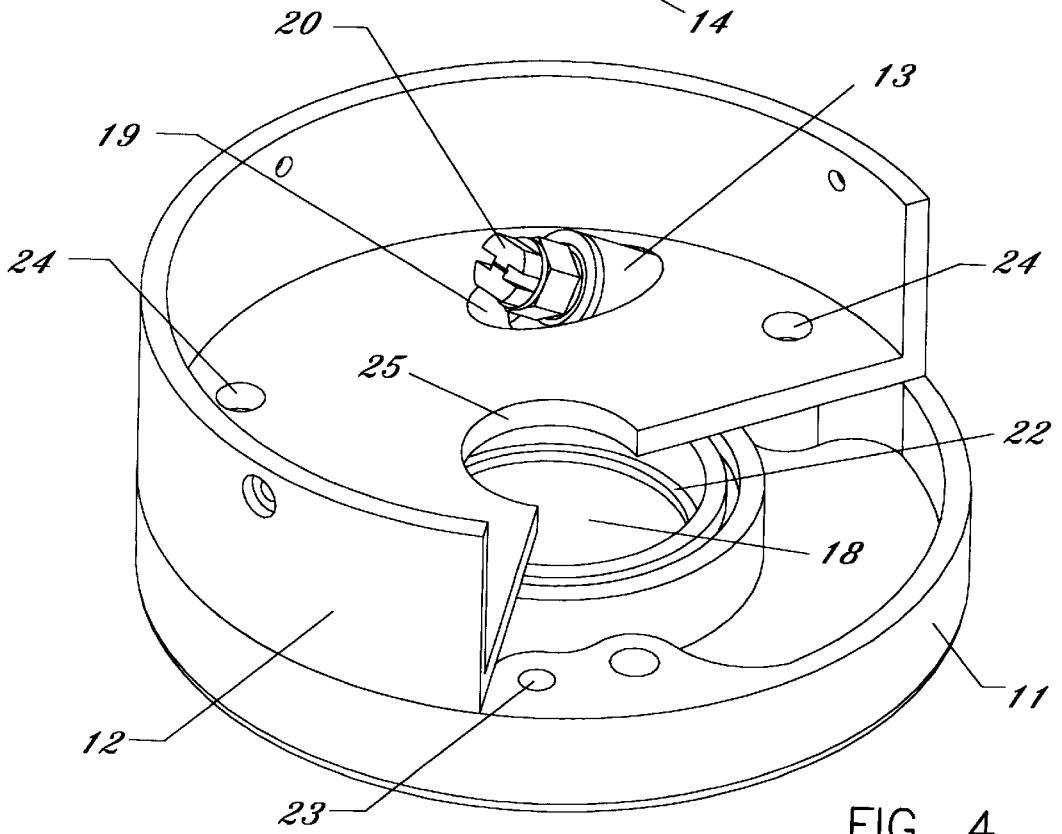
FIG. 4 shows a top perspective view of the housing and shell with nozzle and conduit protruding therethrough partially cut away in cross-section.

Referring now to FIG. 4, a cut-away view of the housing 11, dish 12, and protruding conduit 13 can be clearly seen. The annular rigid housing 11, which is preferably constructed of hard coated, dipped metal, includes a large internal cylindrically-shaped cavity 18. A substantially annular water inlet conduit 13 that allows water to flow under pressure into dish 12 protrudes upwards through a beveled groove 19 in the inner bottom surface of dish 12.

Figure 3:
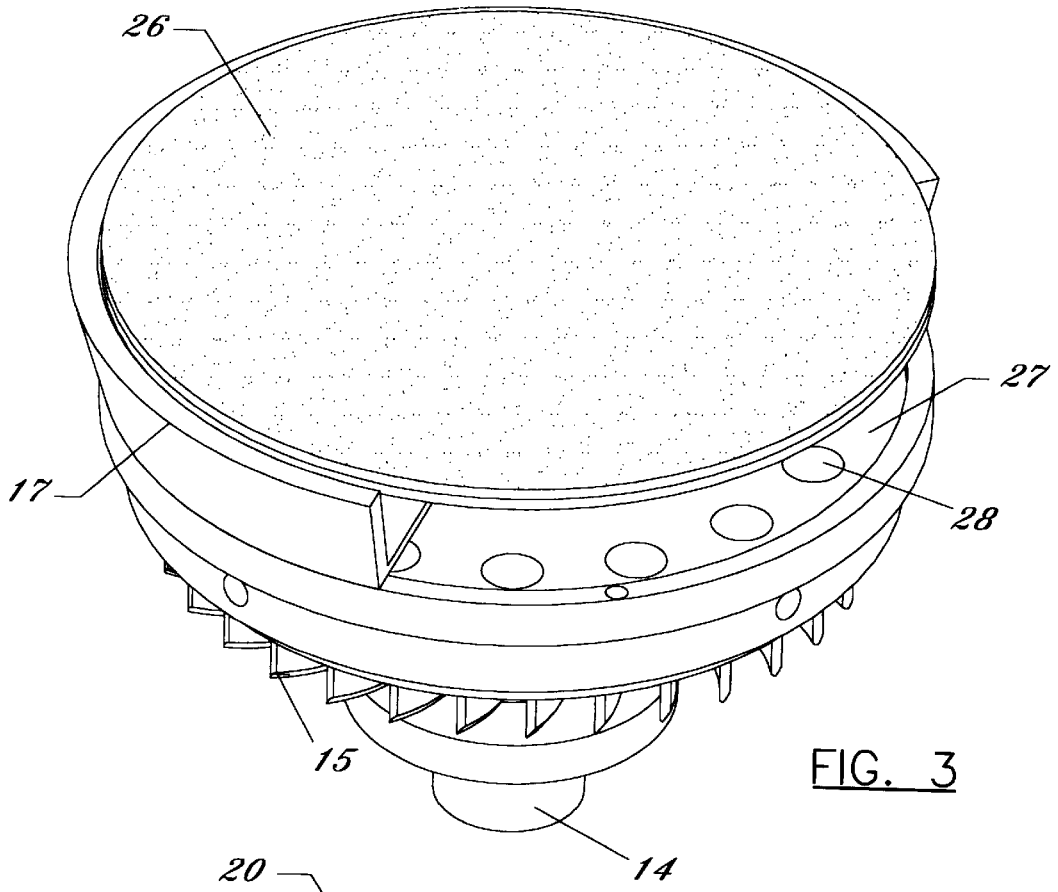
FIG. 3 shows a top perspective view of the grinding disk, shroud, support plate, impeller and drive shaft of the present invention.

Referring to FIG. 4, The cylindrical cavity 18 in housing 11 receives one end of drive shaft 14, seen in FIG. 3, upon which circular impeller 15 is mounted. FIG. 4 shows a circular bearing 22 situated within cavity 18. This bearing 22 helps secure the end of drive shaft 14 within the housing 11.

Situated directly on top of housing 11 is a substantially annular dish 12 having a diameter substantially equal to that of housing 11 thereby allowing the dish to be placed directly on top of the housing and secured thereon via three screws. FIG. 4 shows one of three housing securing holes 23, and two of the handle securing holes 24. Dish 12 also includes a central, cylindrically-shaped orifice 25, concentric with cylindrical cavity 18, which allows drive shaft 14 to protrude therethrough, and an angled, beveled aperture 19 on the dish's bottom portion which allows the elongated inlet conduit 13 which houses nozzle 20, to protrude up through the bottom surface of dish 12. Water exiting inlet conduit 13 passes through nozzle 20 and strikes impeller blades 16 of impeller 15, which is situated within dish 12, causing blades 16 to rotate.

The design of the present invention provides that impeller blades 16 of impeller 15 are in very close proximity to the bottom inner surface of dish 12. The distance between the tip of nozzle 20 and the edge of the impeller blades 16 when the shaft has been secured within the housing and the dish, is approximately 0.5 inches. The water exiting nozzle 20, therefore, has an extremely short distance to travel before striking impeller blades 16. The impingement of the water exiting nozzle 20 at high pressure upon blades 16 causes impeller 15 to spin at very high speed, which in turn, causes drive shaft 14 affixed to impeller 15 and backing pad (not shown) secured to drive shaft 14 to revolve at an equally high speed. Because the backing pad is spinning at very high speed, greater output power is therefore imparted upon sanding disk 26, which is affixed directly to the backing pad. This provides greater power and efficiency when the present invention is in use.

A support plate 27 can be seen in the cut away view of FIG. 3. The support plate 27 contains a central aperture which receives the opposite end of drive shaft 14. A retainer is used to threadably connect the backing pad to drive shaft 14, coupling the backing pad firmly thereto and allowing the circular backing pad to rotate when drive shaft 14 rotates. Plate 27 includes a plurality of relatively small circular apertures or holes 28 situated around the periphery of plate 27 that allow water to pass through when the water is diverted by pressure to the outside edge of dish 12. Around the periphery of the support plate 27, a shroud 17 is affixed, details of which will be discussed below. An improvement of the present invention is the reduction in size and increase in the number of circular apertures 28 around the periphery of the support plate 27. The purpose of the circular apertures 28 is to allow the release of excess water from within dish 12 after the water strikes the impeller blades. The increased number and smaller size of the apertures allows for quieter operation of the rotary tool and more efficient diversion of the water.

The backing pad forms the working surface of the tool that rotates and is affixed thereto to one face of a throw-away grinding or sanding disk 26 much like sandpaper that is the actual working implement. VELCRO™ is the attaching means used on the face of the backing pad to adhere to the inner surface of sanding disk 26, which is also covered in VELCRO™. Thus, the backing pad is the main portion that is rotated with high torque so that a disk attached to its surface can be used as the working tool surface. This is where the grinding and sanding action takes place against the throw-away disk.

In FIG. 4, nozzle 20 protrudes through outlet conduit 13 and up through the beveled opening 19 of dish 12. Nozzle 20 is threadably mounted within conduit 13. Nozzle 20 is a standard nozzle, available in the industry, is removable, and may be easily unscrewed from within the conduit channel by an allen wrench or similar tool and replaced with a different nozzle that has a smaller or larger inside diameter to change the force of the inlet water under pressure that strikes impeller 15. The purpose of a changeable nozzle is that it allows the present invention to be used with numerous different existing high pressure water sources such as high pressure water cleaners that may vary in pressure from 2000 to 3000 PSI. A different pressure source such as between 1500 PSI and 3500 PSI would result in a different RPM of the grinding or sanding surface utilizing the present invention. By having a variable nozzle inside diameter, a more constant RPM can be obtained with the tool, regardless of the different value of the incoming water pressure. One can use an appropriately-sized allen wrench to remove the conduit 13 and easily replace nozzle 20 therein. Nozzle 20 may be made of stainless steel or brass, each with the same outside diameter and annular fitting flange at one end with different and varying inside diameters for changing the flow rate and pressure for variable input pressures.

Referring once again to FIG. 1, the central cylindrical cavity 18 in housing 11 is circular and has its circular center approximately in the center of housing 11. The bearing 22 is mounted centrally and anchored in housing 11, where it secures one end 14B of drive shaft 14 that protrudes through the central hole of dish 12 and into the cylindrical cavity 18 of housing 11. Drive shaft 14 can be seen clearly in FIG. 5. The other end 14A of drive shaft 14 is threadably secured to the backing pad and also secured to support plate 27 via a second circular bearing (not shown). Shaft 14 is attached to impeller 15 via screws. The impeller 15, as seen in FIG. 2, has a central, circular hole 16B that allows for shaft 14 to be inserted therethrough. Impeller 15 will rotate at high speed, within dish 12, due to the pressure exerted upon its blades 16 by the water exiting nozzle 20. This, in turn, rotates drive shaft 14, which is secured to impeller 15, at a corresponding high speed.

The direct drive relationship between the impeller 15 and the drive shaft 14 is the key improvement of the present invention. There are no internal gears that transfer the rotation of the impeller to the drive shaft. The rotation of drive shaft 14 is then imparted upon the backing pad which is secured to the opposite end 14A of shaft 14. Sanding disk 26 which is mounted upon the backing pad rotates at the same RPM as the impeller, therefore providing a high torque output to the sanding disk, leading to improved performance and efficiency for the user.

A disk-shaped shroud member 17 having a divergent peripheral edge that is angled outwardly at approximately 30 degrees, is affixed to the periphery of support plate 27 via threaded fasteners. Shroud member 17 can be seen in FIG. 1 and FIG. 3. Water is directed outwardly from dish 12 and out of the plurality of apertures 28 around the circumference of support plate 27. The water is dispersed along the edge of shroud 17 via centrifugal force. The shroud 17 then directs the water out through the peripheral edge of the support plate 27 and away from the user.

Figure 5:
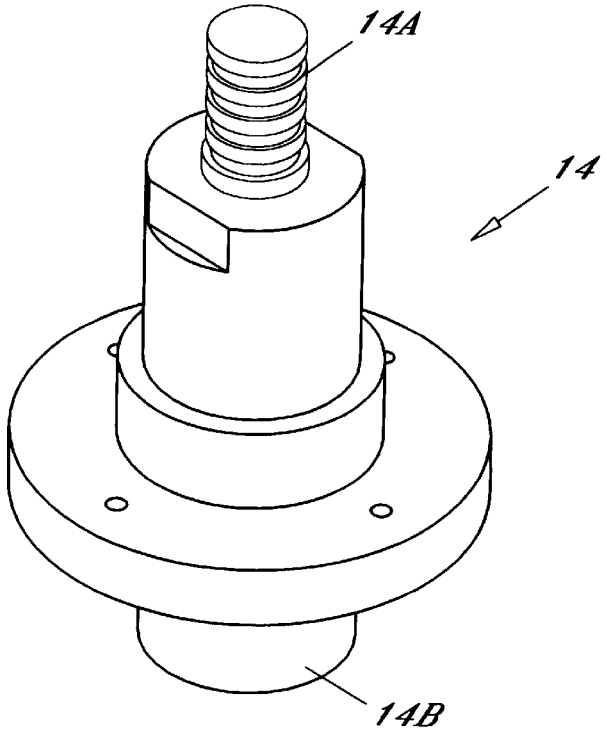
FIG. 5 shows a perspective view of the drive shaft of the present invention.

FIG. 5 shows the drive shaft 14 having opposing ends 14A and 14B, utilized in the present invention. The housing's cylindrical cavity 18, and the dish's cylindrical orifice 25 receive a first end 14B of drive shaft 14. A first circular bearing 22 mounted within housing cavity 18 secures shaft end 14B of drive shaft 14. A second bearing (not shown) mounted to support plate 27 secures and aligns drive shaft 14. The second end 14A of drive shaft 14 includes an approximately 1.25 inch threaded portion that allows it to be threadably attached to the backing pad.

Support plate 27 is fixedly mounted to a disk-shaped shroud 17 having an angled flange along its outside periphery by three threaded fasteners. The drive shaft 14 rotates while the shroud and support plate 17 and 27, respectively, do not rotate.

Drive shaft 14 rotates, due to the turning of impeller 15 to which it is affixed, causing the backing pad and disk 26 to rotate.

The apertures 28 of support plate 27 allow the water to pass from the cylindrical dish 12 where impeller 15 is mounted and outwardly around the edge of the outer cavity periphery where the water is expelled quickly and efficiently by shroud 17. With the cylindrical dish 12 containing impeller 15, support plate 27, and the shroud 17, the device is capable of high torque action safely and conveniently.

Figure 6:
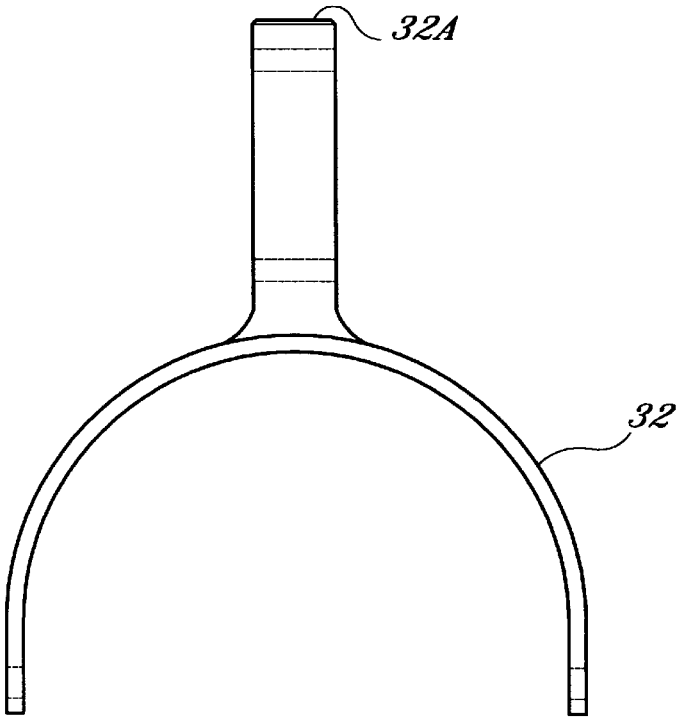
FIG. 6 depicts a side view of the saddle handle.

FIG. 6 shows a U-shaped or saddle handle 32 which can be secured to the housing of the present invention. The saddle-handle can be used in conjunction with a pool pole 33, as seen in FIG. 8, thereby allowing a user to utilize the invention from a standing position.

Figure 8:
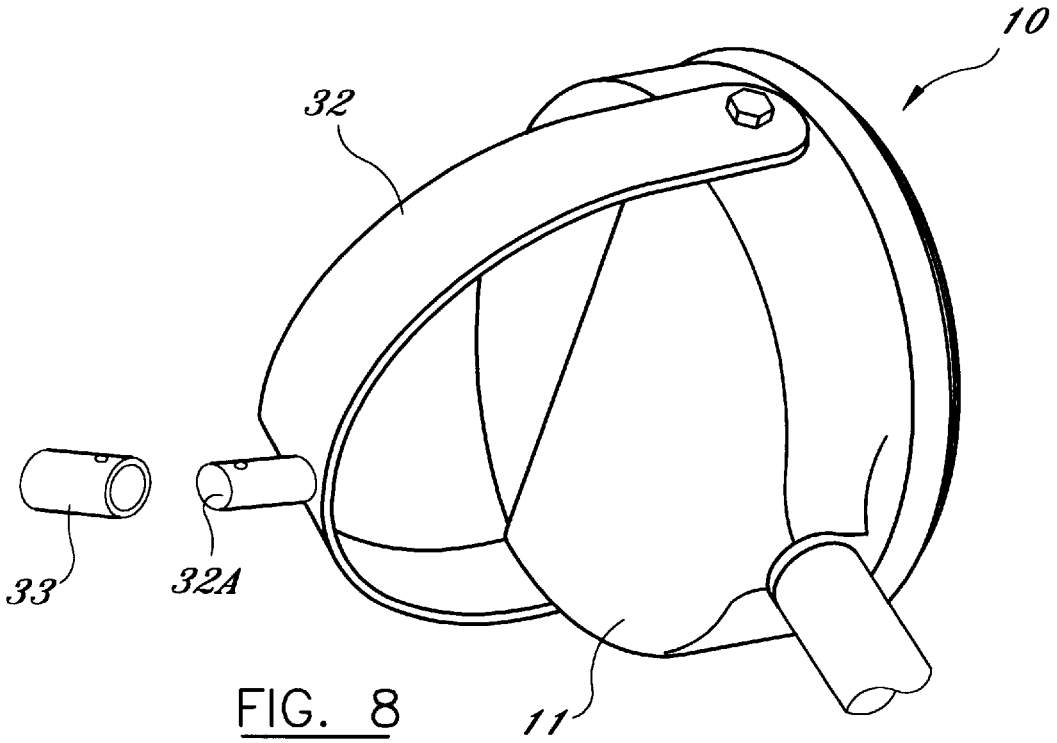
FIG. 8 depicts the saddle handle affixed to the outside of the housing showing the connection to the end of a pool pole.

FIG. 8 shows the saddle handle 32 pivotally connected on each side of the outside of housing 11 that allows it to be rotated to a desired position. Saddle handle 32 has a male extension 32A at the top which allows the female portion of the pool pole 33 to slip over the male portion of the saddle handle to be secured by screws and wing-nuts for remote, stand-up operation.

Figure 7:
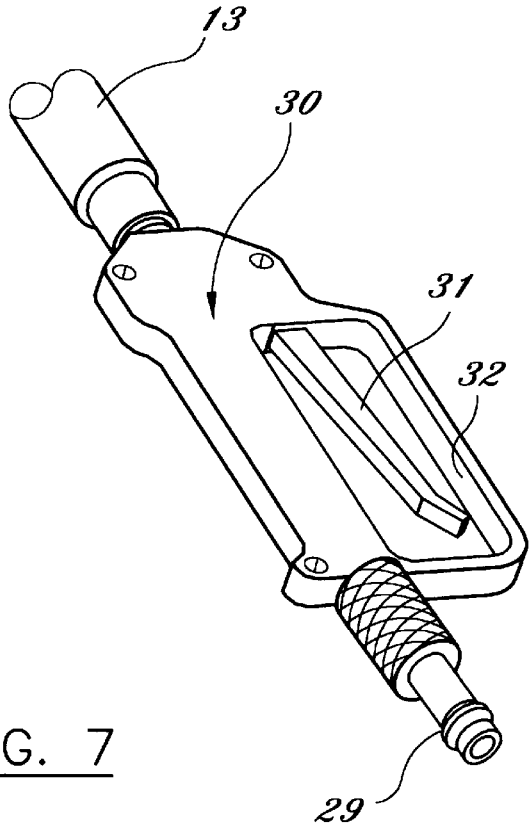
FIG. 7 depicts a perspective view of the quick disconnect conduit release.

FIG. 7 shows a water inlet valve 30 connected at its output side to the water inlet conduit 13 and at its other end to a quick disconnect conduit release 29 that allows the water inlet valve 30 to be connected to a source of water under pressure through the quick disconnect 29. The water inlet valve 30 includes a manually actuated handle lever arm 31 that activates the water inlet valve 30 set forth in a handle casing 32 allowing the user to manually grasp the valve actuating lever arm 31 for squeezing while the hand is mounted on the entire assembly to turn the water pressure on or off (by release) through manipulation of the lever arm 31. The operation of water inlet valve 30 is conventional.

Figure 9:
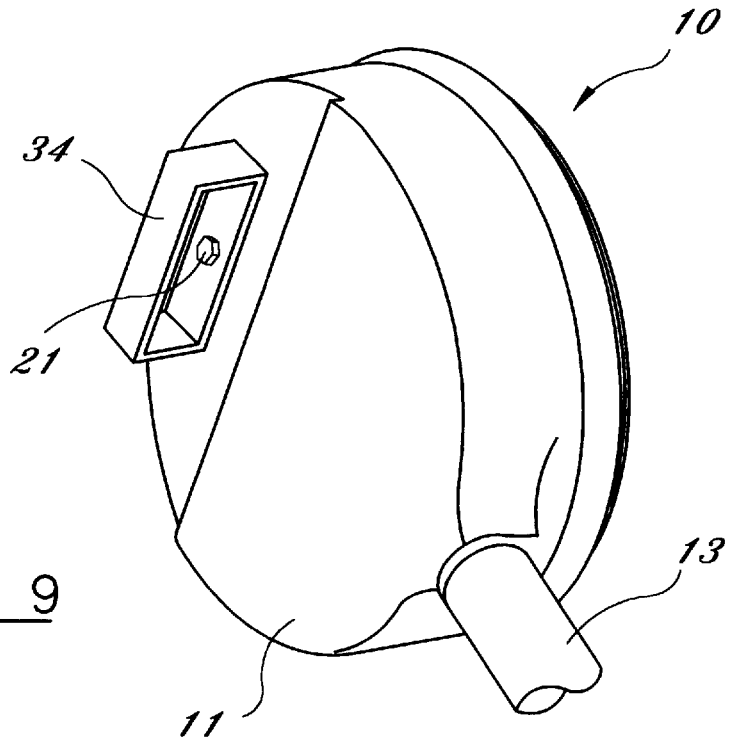
FIG. 9 depicts a perspective view of the present invention with a D-shaped spade handle affixed to the outside of the housing.

FIG. 9 shows a D-shaped spade handle 34 that can be removably affixed to one of three locations on the outside of housing 11. FIG. 9 shows the D-shaped handle affixed directly to the outside portion of the housing via a securing screw 21. This allows close, easy handling of the rotary tool.

To operate the invention, water inlet valve 30 is manually turned on after the device has been connected to a source of high pressure water from a suitable pump, preferably above 1000 psi. Once the manual trigger is actuated, the backing pad and the sanding disk that has been attached thereto will begin to rotate. The operator can utilize the device safely in a water-filled environment or dry environment to reduce sanding and grinding particles and can orient the saddle handle or D-shaped handle to just about any location for ease of operation of the device. Although shown for grinding or sanding, the device is capable of other operations suitable for a rotatable tool that can be used at high torque.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An improved direct drive water-driven rotary tool, comprising:

a substantially annular rigid metal housing having a cylindrical cavity;

a drive shaft having a first and second end wherein said first end is centrally mounted for rotation in said metal housing;

a water-driven impeller rotatably mounted in said cylindrical cavity, said impeller having a central hole to allow for said first end of said drive shaft to be inserted therethrough, said impeller comprising a plurality of blades;

a substantially elongated annular inlet conduit removably connected at one end to and protruding from said housing and removably connected at a second end to a water supply under high pressure, said inlet conduit including a first nozzle having a nozzle tip in fluid communication with said impeller to rotatably drive said impeller;

a cylindrically-shaped dish removably affixed to said housing including a central orifice for said second end of said drive shaft to protrude therethrough;

an annular backing pad removably affixed to said second end of said drive shaft to be rotated thereby;

a disposable working disk for sanding or grinding;

means for attaching said working disk to said backing pad;

said dish comprises a support plate having a plurality of apertures disposed on its outer face such that water that is used to drive said impeller is able to flow through the support plate apertures and escape through centrifugal action; and a shroud sized strategically to fit around the periphery of said dish having predetermined spacing between the periphery of said dish, for deflecting said water that is used to drive said impeller away from said backing pad, said shroud having a substantially annular flange around its periphery.

2. The improved direct drive water-driven rotary tool of claim 1, further comprising a handle connected to said housing.

3. The improved direct drive water-driven rotary tool as recited in claim 2, further comprising an operating means connected to said conduit.

4. The improved direct drive water-driven rotary tool as recited in claim 3, wherein said operating means is in fluid communication with said housing inlet conduit, said operating means includes valve opening and closing means for regulating the flow of water therefrom and to shut off the flow of water.

5. The improved direct drive water-driven rotary tool as recited in claim 4, wherein said valve opening and closing means is a trigger.

6. The improved direct drive water-driven rotary tool as recited in claim 1, wherein said first nozzle is removable and additional nozzles interchangeable with said first nozzle and each having different inside diameters than said first nozzle, may be inserted within said conduit, said changeable nozzles allowing for the use of high pressure water sources of different pressure to obtain the same tool operational RPM.

7. The improved direct drive water-driven rotary tool as recited in claim 1 further comprising a circular bearing securing said first end of said drive shaft within said cylindrical cavity of said housing.

8. The improved direct drive water-driven rotary tool as recited in claim 1, wherein said impeller has a plurality of curved blades around its periphery and wherein said impeller is situated strategically within said cylindrically-shaped dish such that said impeller blades are in close proximity to water escaping from said first nozzle.

9. The improved direct drive water-driven rotary tool as recited in claim 8, wherein said impeller blades are curved and beveled to allow for more precise directioning of water exiting said first nozzle toward each said impeller blade thereby increasing torque.

10. The improved direct drive water-driven rotary tool as recited in claim 1, wherein said backing pad is removably threaded upon said drive shaft such that there exists sufficient space between said support plate and said backing pad to allow for the insertion of a wrench or similar tool between said backing pad and said support plate in order to facilitate removal of said backing pad.

11. The improved direct drive water-driven rotary tool as recited in claim 1, wherein said attaching means comprises a strip of hooks and loops fastening tape situated upon attaching surface of said backing pad and upon attaching surface of said working disk.

12. The improved direct drive water-driven rotary tool as recited in claim 2, wherein said handle is a substantially U-shaped saddle-handle having a protrusion, said rotary tool further comprising an elongated pool pole removably affixed to said protrusion and two opposing ends pivotally secured to an outer rim portion of said housing via securing means thereby allowing a user to control said rotary tool from a standing position.

13. The improved direct drive water-driven rotary tool as recited in claim 2, wherein said handle comprises a substantially D-shaped handle removably affixed to said housing thereby allowing a user to control said rotary tool from a position in close proximity to an operating surface.

14. An improved direct drive water-driven rotary tool, comprising:

a substantially annular rigid metal housing having a cylindrical cavity;

a drive shaft having first and second ends wherein said first end is centrally mounted for rotation in said metal housing;

a water-driven impeller mounted rotatably in said cylindrical cavity, said impeller having a central hole to allow for said first end of said drive shaft to be inserted therethrough;

a substantially elongated annular inlet conduit removably connected at one end to and protruding from said housing and removably connected at a second end to a water supply under high pressure, said inlet conduit including a first nozzle having a nozzle tip in fluid communication with said impeller to rotatably drive said impeller;

a cylindrically-shaped dish removably affixed to said housing including a central orifice for said second end of said drive shaft to protrude therethrough;

an annular backing pad removably affixed to said second end of said drive shaft to be rotated thereby;

a disposable working disk for sanding or grinding, attached to said backing pad via a strip of hooks and loops fastening tape situated upon attaching surfaces of said backing pad and said working disk;

said dish comprises a support plate having a plurality of apertures disposed on its outer face such that water that is used to drive said impeller is able to flow through the support plate apertures and escape through centrifugal action;

a shroud sized strategically to fit around the periphery of said dish having predetermined spacing between periphery of said dish, for deflecting said water that is used to drive said impeller away from said backing pad, said shroud having a substantially annular flange around its periphery;

a handle connected to said housing wherein said handle is a substantially U-shaped saddle-handle having a protrusion, said rotary tool further comprising an elongated pool pole removably affixed to said protrusion and to opposing ends pivotally secured to an outer rim portion of said housing via securing means thereby allowing a user to control said rotary tool from a standing position, or a substantially D-shaped handle removably affixed to said housing thereby allowing a user to control said rotary tool from a position in close proximity to an operating surface;

operating means connected to said conduit, wherein said operating means is in fluid communication with said conduit, said operating means includes a trigger for regulating the flow of water therefrom and to shut off the flow of water;

said first nozzle is removable and additional nozzles interchangeable with said first nozzle and each having different inside diameters than said first nozzle, may be inserted within said conduit, said changeable nozzles allowing for the use of high pressure water sources of different pressure to obtain the same tool operational RPM;

a circular bearing securing said first end of said drive shaft within said cylindrical cavity of said housing;

said impeller having a plurality of curved, beveled blades around its periphery to allow for more precise directioning of water exiting said first or second nozzle toward each said impeller blade thereby increasing torque, wherein said impeller is situated strategically within said cylindrically-shaped dish to be in close proximity to water escaping from said nozzle; and said backing pad is removably threaded upon said drive shaft such that there exists sufficient space between said support plate and said backing pad to allow for the insertion of a wrench or similar tool between said backing pad and said support plate in order to facilitate removal of said backing pad.

15. The improved direct drive water-driven rotary tool of claim 1 wherein the distance between said first nozzle tip and said impeller blades is approximately 0.5 inches.

* * * * *